US005586386A

United States Patent [19]

Morin

[11] Patent Number: 5,586,386

[45] Date of Patent: Dec. 24, 1996

[54] SENSOR FOR USE WITH AIR BAG INFLATOR AND METHOD FOR MAKING

[75] Inventor: Daniel Morin, North Providence, R.I.

[73] Assignee: Texas Instruments Incorporated, Dallas, Tex.

[21] Appl. No.: 559,217

[22] Filed: Nov. 16, 1995

Related U.S. Application Data

[62] Division of Ser. No. 323,955, Oct. 17, 1994, Pat. No. 5,504,288.

[51] Int. Cl.[6] ..... H01H 35/34

[52] U.S. Cl. ..... 29/622; 73/723; 200/83 A; 200/83 P; 280/736

[58] Field of Search ..... 340/605, 626; 307/10.1, 118; 73/717, 723, 725, 861.47; 338/179, 200; 92/5 R, 103 M; 280/736, 741; 29/592.1, 622; 200/83 P, 83 A, 83 R, 83 B, 83 W, 83 J, 81 R, 61.08, 61.25, 283, 284, 300, 306

[56] References Cited

U.S. PATENT DOCUMENTS

| | | | |
|---|---|---|---|
| 3,756,621 | 9/1973 | Lewis et al. . | |
| 3,944,769 | 3/1976 | Wagner . | |
| 4,049,935 | 9/1977 | Gruber | 200/83 P |
| 4,981,534 | 1/1991 | Scheffe . | |
| 5,225,643 | 7/1993 | Marchant . | |
| 5,263,740 | 11/1993 | Frey | 280/737 |
| 5,331,126 | 7/1994 | Dwyer et al. | 200/83 P |
| 5,356,176 | 10/1994 | Wells . | |
| 5,437,188 | 8/1995 | Frantom | 73/709 |
| 5,491,884 | 2/1996 | Potts | 29/622 |

FOREIGN PATENT DOCUMENTS

| | | |
|---|---|---|
| 4141922 | 8/1992 | Germany . |
| 9322781 | 11/1993 | WIPO . |

*Primary Examiner*—Gerald P. Tolin
*Attorney, Agent, or Firm*—Russell E. Baumann; Richard L. Donaldson; Rene' E. Grossmann

[57] ABSTRACT

A pressure responsive sensor 10 for use with a vehicular air bag inflation system is shown having an electric switch 24 actuatable by a snap acting disc 40 when the gas pressure in the gas storage bottle 48 decreases to a selected low level. The snap acting disc 40 is exposed on one side to the gas mixture P1 in bottle 48 and the opposite side to a reference gas mixture P2 in a reference chamber 34. The gas mixture P2 in the reference chamber is filled to a lower pressure level than hat in the bottle in order to provide switch actuation at the desired level and comprises a mixture of gases to enhance leakage testing and tracking of the pressure vs. temperature characteristic curve of the bottle gas mixture.

4 Claims, 1 Drawing Sheet

SENSOR FOR USE WITH AIR BAG INFLATOR AND METHOD FOR MAKING

This application is a division of application Ser. No. 08/323,955, filed Oct. 17, 1994 now U.S. Pat. No. 5,504, 288.

BACKGROUND OF THE INVENTION

This application relates generally to the monitoring of gas pressure levels in an enclosed vessel and more particularly to apparatus for monitoring a pressurized gas used in hybrid air bag systems for motor vehicles and a method for making such apparatus.

The use of air bags for passengers, as well as drivers, in motor vehicles is becoming more and more widespread. Early versions of air bag systems made use of pyrotechnic inflators in which a rapid oxidation of sodium azide cause the air bags to inflate in a very short period of time; however, the use of sodium azide has several disadvantages. It is hazardous to process, toxic to unprotected workers and is a powerful, unstable explosive during processing.

As a result, a modified air bag inflator is becoming more popular. In the modified system, known as a hybrid inflator, a pressurized gas, typically argon, an inert gas, is used in combination with a smaller amount of less hazardous solid propellant to inflate the air bag. Although hybrid systems take slightly longer to effect inflation and require a heavier steel housing rather than aluminum used for the pyrotechnic versions, substituting argon gas for a solid propellant substantially lowers the cost of the inflation system and is less hazardous to process.

A module used in an air bag system comprises an inflator, a metal housing and an inflatable bag. The hybrid version also requires a separate electronic circuit including a sensor to monitor the bottle pressure for the stored gas. That is, it is necessary to be able to determine that the pressure of the stored gas is above a selected level to ensure effective deployment of the air bag when called for.

Space occupied by air bag systems currently in use is at a premium, particularly with respect to the drivers' side. As a result, the space available for the sensor system is very limited. In U.S. Pat. No. 5,331,126 assigned to the assignee of the present invention, a sensor system in the form of a pressure responsive switch useful in hybrid air bag systems is shown and described. The assembly comprises a pressure responsive disc movable between oppositely dished concave, convex configurations having one side exposed to gas contained in a small gas reference chamber. The opposite side of the disc is operatively connected to a movable contact arm of an electric switch and is exposed to the gas used for inflation which is stored in a container, also referred to as a bottle. The assembly is hermetically attached to a wall within the air bag bottle and when terminals of the switch are connected to a suitable voltage source the switch will monitor the pressure in the air bag bottle. If the pressure in the bottle should decrease to a selected level indicating inadequate inflator bottle pressure, the disc will snap to open a circuit.

Although different gases can be used in the air bottle, argon, as mentioned above, has become the usual choice due in part to its properties and availability, i.e., it is inert, relatively heavy and has a sufficiently low liquefaction temperature. A small amount of helium, usually in the range of 2–5% is added in order to facilitate leakage testing. Leakage of gas from the air bag bottle is checked at the time of manufacture to ensure that sufficient pressure will remain in the bottle for intended operation of the system over a selected life span, e.g., fifteen years and helium is used for this purpose since suitable equipment and techniques are available for detecting and measuring helium.

The air bag bottle is charged with the gas mixture at a selected pressure and temperature and the reference chamber is charged to a pressure slightly lower so that in the event that gas does leak from the bottle, when the pressure in the bottle decreases to a calibrated level, the differential pressure between the stored gas and the gas in the reference chamber will cause the disc to snap and actuate the electrical switch and provide a warning of the low pressure condition.

By way of example, a typical air bag bottle for the passenger side of a vehicle uses a mixture of 98% argon and 2% helium and is charged at room temperature to 2800 psi. The system is considered to provide effective operation as long as the pressure remains above 2400 psi at room temperature. In order to provide effective monitoring, when using a switch assembly of the type set forth in the above referenced patent, the reference chamber is charged to a pressure of approximately 2300 psi so that, along with the release pressure of approximately 100 psi of the disc, switching will occur at the desired level.

However, charging the reference gas to a lower pressure than the stored gas results in different slopes of the pressure vs temperature curves if the same gas mixture is employed. This causes a tracking problem since the system needs to be operable over a wide temperature range, i.e., from –40° C. to 90° C. Another problem occurs with regard to leakage testing to ensure that the device will meet specifications for the expected life. The reference chamber is so small and at 2% the total amount of helium is so little that it is impractical, if not technically impossible, to reliably test for such minute quantities with currently available equipment.

SUMMARY OF THE INVENTION

It is an object of the invention to provide an air bag bottle system having a monitoring sensor system which is not subject to the prior art limitations noted above. Another object of the invention is the provision of a monitoring sensor system for use with an air bag bottle which closely and reliably tracks the pressure of gas in the air bag bottle over a selected temperature range yet is conducive to low cost manufacture.

Briefly, in accordance with the invention, a pressure switch system for use as a sensor in a hybrid air bag system has a pressure responsive disc movable between oppositely dished concave, convex configurations having one face surface exposed to gas contained in a reference chamber. The opposite face surface of the disc is operatively connected to a movable contact arm of an electric switch and is exposed to the gas stored in the bottle. The gas in the reference chamber is charged to a selected pressure level lower than that of the gas in the bottle in order to provide a selected low pressure level at which the disc will snap and actuate the electric switch to provide a warning of a low pressure condition in the bottle. When used with a bottle gas mixture of argon and helium the mixture of gas in the reference chamber comprises, in addition to argon, an increased percentage of helium and an additional gas having a steeper slope of the pressure vs temperature curve than that of argon in order to match the pressure vs temperature curve of the gas mixture in the bottle. For use with bottle gas of 98% argon and 2% helium a suitable reference gas mixture comprises carbon dioxide, in addition to a higher amount of helium, a particularly advantageous mixture being 60% argon, 24% carbon dioxide and 16% helium thereby matching the slope of the pressure vs temperature curve of the gas mixture in the bottle while providing a significantly greater amount of helium for leakage testing. For different bottle gas compositions and mixtures the specific amount of carbon the steeper sloped additional gas used, as well as helium, can be adjusted to provide a match of the pressure vs temperature characteristic. Gases other than carbon dioxide can be used, such as nitrous oxide which, like carbon dioxide, has a steep slope of the pressure vs temperature curve and a suitable liquefaction temperature when added in an acceptable concentration level.

Other objects, uses and advantages of this invention will be apparent from a reading of the description with reference to the accompanying drawings.

DESCRIPTION OF THE PREFERRED EMBODIMENTS

Figure 1:
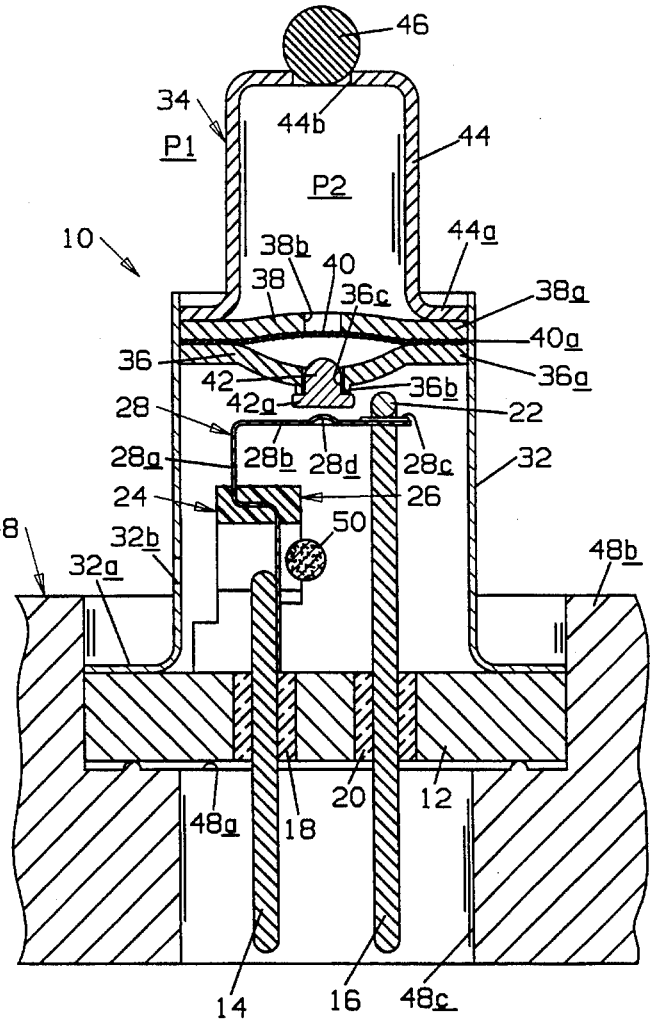
FIG. 1 is a cross sectional view of an air bag sensor switch system hermetically mounted on the wall of an air bag gas bottle.

With reference to FIG. 1, a sensor switch system 10 having a reference chamber 34 charged with a gas mixture in accordance with the invention is shown. Switch system 10 comprises a header 12 formed of suitable weldable material such as steel having first and second spaced electrically conductive terminals 14, 16 mounted in apertures formed in the header and electrically separated from one another by suitable electrically insulative material such as glass 18, 20 respectively to form an hermetic seal. Terminal 16 has a free distal end 22 bent over to form a laterally extending leg extending approximately 90° to an imaginary line drawn between the terminals for a purpose to be described below.

A movable arm assembly 24 comprises a base 26 formed of suitable electrically insulative material, preferably a moldable plastic material. An electrically conductive member 28 is mounted on base 26 electrically connected to terminal 14. Member 28 has an upwardly extending movable contact arm portion 28*a* with a laterally extending portion 28*b* formed with an electrical contact portion 28*c* at a free distal end thereof received under free distal end 22 of terminal 16. An upwardly extending (as seen in FIG. 1) dimple 28*d* is formed in laterally extending portion 28*b* which cooperates with suitable motion transfer means such as a pin 42 to be discussed below, to transfer motion to movable contact arm assembly 28.

A generally cylindrical sleeve 32 formed of suitable material such as steel is attached to header 12 by any conventional means such as by welding flange 32*a* formed at one end of sleeve 32 to the header. A vent aperture 32*b* may be formed through the wall of sleeve 32 for a purpose to be described below.

A pressure sensor assembly 34 is formed of first and second generally circular support plates 36 and 38 each having an outer flange portion 36*a*, 38*a* respectively capturing therebetween the outer flange 40*a* of a snap acting disc 40. Support plates 36, 38 each has a central portion dished in opposite concave, convex configurations to provide space to allow the central portion of the disc 40 to snap between a first normal, at rest, upwardly concave configuration, shown in dashed lines in FIG. 1, and a second upwardly convex configuration, shown in solid lines, when subjected to a selected pressure or force on the lower side of the disc as seen in the figure. Support plate 36 is formed with a hub 36*b* through which a bore 36*c* is formed. A motion transfer pin 42 is loosely received in bore 36*c* allowing equalization of pressure on both sides of support 36. Pin 42 is formed with a radial flange 42*a* extending beyond the diameter of bore 36*c* to limit travel of pin 42 into bore 36*c*.

A reference chamber comprising a cup-shaped housing 44 of steel or other suitable material having an outwardly extending flange 44*a* at one end thereof matching that of flanges 36*a*, 38*a* is hermetically attached thereto as by welding around its periphery. An aperture 38*b* is formed in support plate 38 to allow equalization of pressure on both sides of support plate 38. An orifice 44*b* is formed at another end of housing member 44 permitting evacuation of and infilling the reference chamber with a selected atmosphere and pressure to be discussed below. The chamber is then sealed with a suitable seal as by welding a spherical seal member 46 to the housing.

The system is inserted in an air bag pressure bottle 48 as by placing header 12 on a seat 48*a* formed in wall 48*b* of a bottle formed of conventional material such as steel and is hermetically attached to seat 48*a* as by welding around the periphery of the header. A centrally disposed bore 48*c* communicating with seat 48*a* provides access to terminals 14, 16 for connection to a suitable circuit for monitoring the status of the system. In order to provide a diagnostic capability electrically conductive member 28 may be separated into first and second portions and electrically connected in series through a resistor 50.

Further details of the switch system can be obtained in U.S. Pat. No. 5,331,126 the subject matter of which is incorporated herein by this reference.

Figure 2:
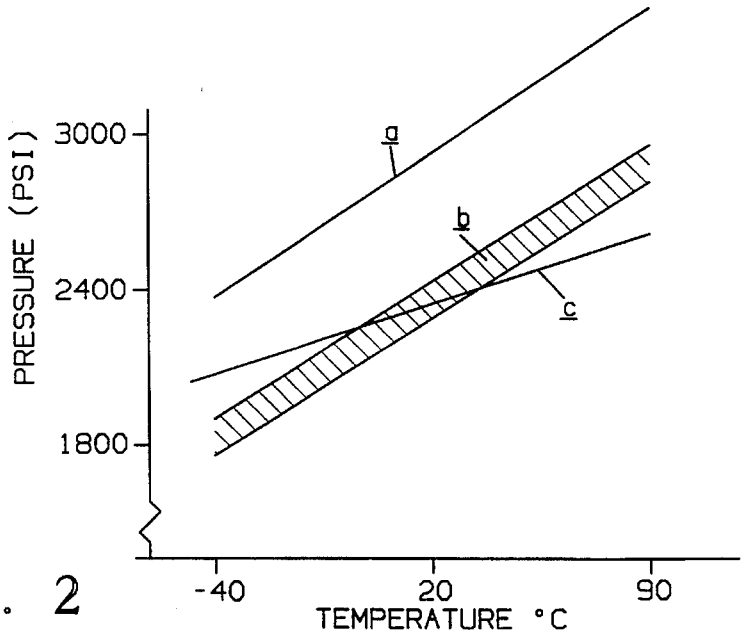
FIG. 2 is a graph of pressure vs temperature of a gas mixture comprising 98% argon, 2% helium gas charged to 2800 psi at 20° C. over a temperature range of −40° C. to 90° C. and showing the band of pressure over temperature within which the sensor switch system is to actuate. Also shown is the pressure vs temperature line of the same mixture in the reference chamber at 2300 psi at 20° C. having a different slope.

As stated supra, a typical gas mixture in bottle 48 comprises argon and helium. For the passenger side system one such mixture comprises 98% argon and 2% helium. When filled at a pressure P1 of 2800 psi in bottle 48 at a temperature 20° C. the pressure vs temperature curve of that mixture is shown in FIG. 2 at a. Specifications for the air bag system call for switch system 10 to actuate at 2400 psi at 20° C. within a selected tolerance, e.g., ±5% and to track the pressure of the gas mixture in a bottle between −40° C. to 90° C. shown as band b in the figure. The fill pressure P2 of gas in reference chamber 34 at 20° C. is selected to be lower than that in the bottle, e.g., 2300 psi so that along with the release pressure of the disc actuation of disc 40 will occur at 2400 psi at 20° C. in the event that leakage from the bottle should decrease the gas pressure to that level. However, the slope of a mixture of 98% argon and 2% helium filled at an appropriately lower pressure to provide that actuation results in curve c for the reference chamber gas having a shallower slope than that of curve a so that the pressure of reference chamber would not properly track the pressure of the bottle over the necessary temperature range.

The need for providing suitable leakage testing exacerbates this problem, as mentioned above. Based on the volume of bottle 48, 2% helium is adequate to provide leakage testing using currently available equipment which has a sensitivity on the order of $1\times10^{-9}$ cc/sec to ensure that over a selected expected life of 15 years sufficient pressure will remain in the bottle so that the system will operate as intended. However, chamber 34 is so much smaller that the amount of helium present in the chamber at a 2% ratio is so little that it becomes impractical to measure the leakage level. That is, sensitivity of the measuring equipment to satisfactorily measure leakage to ensure a fifteen year life would need to be in the order of $1\times10^{-10}$ cc/sec. In order to provide such testing a larger amount of helium in the reference chamber is necessary; however, the slope of helium is even shallower than that of argon. For example, at 3000 psi at 20° C. argon has a slope of approximately 13.63 while helium has a slope at that pressure and temperature of approximately 10.26 so that an increase in the percentage of helium would result in a greater mismatch of the slopes of the mixtures.

According to the invention, a gas having a slope of the pressure vs temperature curve which is relatively steep compared to the major constituent of the gas stored in the bottle, in the example described, argon, and having a suitable low critical temperature at which the gas turns to liquid at a given pressure, is added to the reference gas to tailor the slope of the mixture to match that of the bottle as well as to allow an increase of the amount of helium to improve the accuracy of the leakage testing procedure. By way of comparison, carbon dioxide filled at 3000 psi at 20° C. has a slope of approximately 18.72, significantly steeper than that of argon and helium. For the above mentioned bottle mixture of 98% argon, 2% helium, a suitable reference gas mixture comprises 60% argon, 16% helium and 24% carbon dioxide. The specific percentage of the several gases can be varied to match the slope of bottle gases having other specific mixtures. For example, in driver's side systems in which the volume of the bottle is smaller, a larger amount of helium may be used, e.g., 5%, in order to facilitate leakage testing. This mixture would provide a somewhat shallower curve than curve a and therefore a slightly higher percentage of helium could be employed with slightly less carbon dioxide to still provide a match of the slope of the bottle gas mixture. At the relevant pressures liquefaction of carbon dioxide does not present a problem until the percentage is increased to a level higher than 24% of the mixture at these pressures.

While carbon dioxide is preferred due to its combination of properties, availability and low cost, other gases can be used to tailor the slope either with or in place of carbon dioxide, such as nitrous oxide which has a slope essentially the same as carbon dioxide and is non-toxic. However, most gases are not suitable for various reasons such as having too high a critical temperature, instability, toxicity, expense, and so on.

Although the invention has been described with respect to specific preferred embodiments thereof, variations and modification will become apparent to those skilled in the art. It will be understood that the invention can be used with both bottle gases in which a gas other than argon is employed for inflating the bag. Further, gases other than helium can be used for leakage testing. It is therefore the intention that the appended claims be interpreted as broadly as possible in view of the prior art to include all such variations and modifications.

What is claimed:

1. A method for making a monitoring system for a vehicular inflator air bag system in which a first gas mixture for use in inflating an air bag is stored in a container at a prescribed pressure at a selected temperature, the first gas mixture selected from any two amounts of the group of gases consisting of argon, nitrogen and helium and having a pressure vs temperature curve with a given slope comprising the steps of forming a reference gas chamber, taking a snap acting disc having opposed first and second face surfaces, mounting the snap acting disc so that the first face surface is exposed to the first gas mixture and the second face surface is exposed to gas in the reference gas chamber, filling the reference gas chamber with a second gas mixture at a selected pressure lower than the pressure of the first gas mixture at the selected temperature, said second gas mixture selected from the group of gases for the first gas mixture and including at least one additional gas and having a pressure vs temperature curve with a slope steeper than the slope of the pressure vs temperature curve of the first gas mixture and choosing a sufficient quantity of the additional gas so that the slope of the pressure vs temperature curve of the first and second gas mixtures are essentially the same.

2. A method according to claim 1 in which the first gas mixture comprises argon and the at least one additional gas in the second gas mixture is one of carbon dioxide and nitrous oxide.

3. A method according to claim 1 in which the first gas mixture comprises argon and a minor percentage of helium including the step of providing a greater percentage of helium in the second gas mixture and the at least one additional gas in the second gas mixture is one of carbon dioxide and nitrous oxide.

4. A method according to claim 1 in which the first gas mixture comprises approximately 98% argon and 2% helium and the second gas mixture comprises approximately 60% argon, 16% helium and 24% carbon dioxide.

* * * * *